US011286581B2

(12) United States Patent
Ikuta et al.

(10) Patent No.: US 11,286,581 B2
(45) Date of Patent: Mar. 29, 2022

(54) METHOD FOR MANUFACTURING ACRYLONITRILE BASED FIBER BUNDLE AND METHOD FOR MANUFACTURING CARBON FIBER BUNDLE

(71) Applicant: Toray Industries, Inc., Tokyo (JP)

(72) Inventors: Hiroyoshi Ikuta, Tokyo (JP); Takeya Ohashi, Ehime (JP); Tomoki Tamura, Otsu (JP)

(73) Assignee: Toray Industries, Inc., Tokyo (JP)

( * ) Notice: Subject to any disclaimer, the term of this patent is extended or adjusted under 35 U.S.C. 154(b) by 283 days.

(21) Appl. No.: 16/492,308

(22) PCT Filed: Mar. 9, 2018

(86) PCT No.: PCT/JP2018/009194
§ 371 (c)(1),
(2) Date: Sep. 9, 2019

(87) PCT Pub. No.: WO2018/168685
PCT Pub. Date: Sep. 20, 2018

(65) Prior Publication Data

US 2021/0130984 A1 May 6, 2021

(30) Foreign Application Priority Data

Mar. 15, 2017 (JP) ..... JP2017-049437

(51) Int. Cl.
*D01D 5/04* (2006.01)
*D01D 5/06* (2006.01)
(Continued)

(52) U.S. Cl.
CPC ..... *D01F 6/18* (2013.01); *D01D 5/16* (2013.01); *D01F 6/38* (2013.01); *D01F 9/225* (2013.01);
(Continued)

(58) Field of Classification Search
CPC . D01D 5/04; D01D 5/06; D01D 10/02; D01F 6/38; D01F 9/22; D01F 9/225;
(Continued)

(56) References Cited

U.S. PATENT DOCUMENTS 3,925,524 A * 12/1975 Kimmel ..... D01F 9/225 264/206 X
6,428,891 B1 * 8/2002 Okuya ..... D01D 10/02 264/206 X
(Continued)

FOREIGN PATENT DOCUMENTS

CN 102061531 A * 5/2011 ..... D01D 5/12
JP 05195313 A 8/1993
(Continued)

OTHER PUBLICATIONS

Translation of CN 102061531 A (published on May 18, 2011).*
(Continued)

*Primary Examiner* — Leo B Tentoni
(74) *Attorney, Agent, or Firm* — RatnerPrestia

(57) ABSTRACT

A drawing method is provided which enables a pressurized steam drawing of an acrylonitrile-based fiber bundle used as the precursor fiber of the carbon fiber bundle. In particular, a drawing method is provided which realizes a high processability when this treatment is conducted at a high draw ratio and high speed. This invention is a method for producing an acrylonitrile-based fiber bundle which includes the steps of spinning a spinning solution containing an acrylonitrile-based copolymer, and subjecting the fiber bundle to a pressurized steam drawing in a pressurized steam drawing apparatus (A) having at least two zones which are a preheating zone on the fiber bundle inlet side and a heating zone on the fiber bundle exit side, the two zones being separated by a seal member. The preheating zone is in a pressurized steam atmosphere at 0.05 to 0.35
(Continued)

MPa, the heating zone is in a pressurized steam atmosphere at 0.45 to 0.70 MPa, temperature difference ΔT1 in the preheating zone of the steam drawing apparatus in the fiber bundle-moving direction defined in the specification is up to 5° C., and temperature difference ΔT2 in the preheating zone of the steam drawing apparatus in the cross-sectional direction of the steam drawing apparatus defined in the specification is up to 5° C.

4 Claims, 1 Drawing Sheet

(51) Int. Cl.

| | |
|---|---|
| ***D01D 10/02*** | (2006.01) |
| ***D02J 1/22*** | (2006.01) |
| ***D02J 13/00*** | (2006.01) |
| ***D01F 6/18*** | (2006.01) |
| ***D01D 5/16*** | (2006.01) |
| ***D01F 6/38*** | (2006.01) |
| ***D01F 9/22*** | (2006.01) |

(52) U.S. Cl.
CPC ..... *D02J 1/222* (2013.01); *D02J 1/225* (2013.01); *D10B 2321/10* (2013.01)

(58) Field of Classification Search
CPC .... D02J 1/22; D02J 1/222; D02J 1/225; D02J 13/00; D10B 2321/10
USPC ..... 264/29.2, 29.6, 182, 184, 206, 210.8, 264/211.14, 211.15, 211.17; 423/447.6, 423/447.7
See application file for complete search history.

(56) References Cited

U.S. PATENT DOCUMENTS

2006/0255549 A1* 11/2006 Amos ..... F16J 15/0887 277/644
2016/0151959 A1* 6/2016 Tada ..... D01F 9/22 264/164

FOREIGN PATENT DOCUMENTS

| | | | | | |
|---|---|---|---|---|---|
| JP | 05263313 | A | | 10/1993 | |
| JP | 2000009618 | A | * | 1/2000 | ..... G01N 3/00 |
| JP | 2008214795 | A | | 9/2008 | |
| JP | 2009174073 | A | | 8/2009 | |
| JP | 2015030923 | A | | 2/2015 | |

OTHER PUBLICATIONS

Translation of abstract and Figure 1 of CN 102061531 A1 (published on May 18, 2011).*
Translation of JP 2000-9618 A (published on Jan. 14, 2000).*
International Search Report and Written Opinion for International Application No. PCT/JP2018/009194, dated May 22, 2018—5 pages.

* cited by examiner

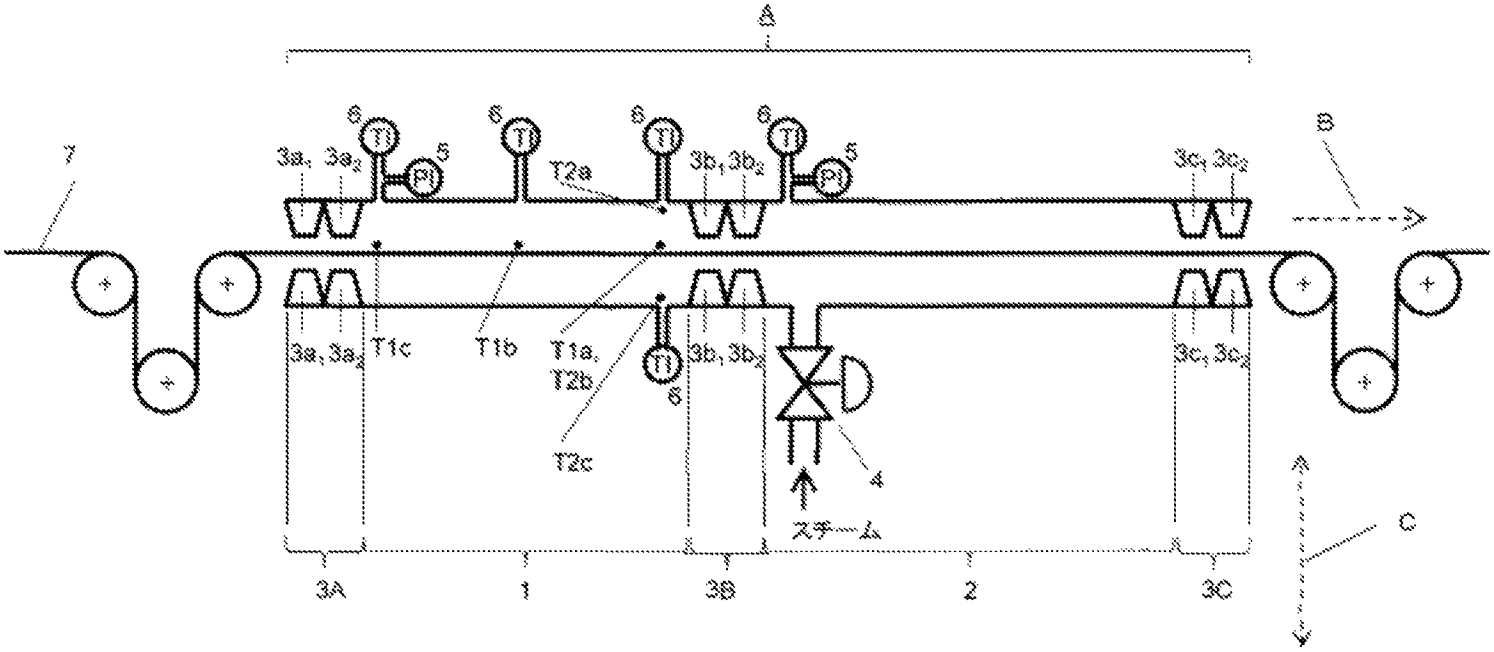
A
B
C
7
6
5
4
2
1
3A
3B
3C
T1a, T2b
T1b
T1c
T2a
T2c

METHOD FOR MANUFACTURING ACRYLONITRILE BASED FIBER BUNDLE AND METHOD FOR MANUFACTURING CARBON FIBER BUNDLE

CROSS REFERENCE TO RELATED APPLICATIONS

This is the U.S. National Phase application of PCT/JP2018/009194, filed Mar. 9, 2018, which claims priority to Japanese Patent Application No. 2017-049437, filed Mar. 15, 2017, the disclosures of these applications being incorporated herein by reference in their entireties for all purposes.

FIELD OF THE INVENTION

The present invention relates to a method for stably producing a high quality acrylonitrile-based fiber bundle which is adapted for use in the production method of a carbon fiber bundle.

BACKGROUND OF THE INVENTION

In the production of an acrylonitrile-based fiber bundle which is used as a precursor fiber for the carbon fiber bundle, use of the drawing by pressurized steam has been known since high temperature can be obtained by using hot water at atmospheric pressure, and presence of moisture has the effect of plasticization of the acrylonitrile-based fiber bundle which in turn enables drawing at a high drawing ratio. However, the drawing of the acrylonitrile-based fiber bundle by the pressurized steam drawing at a high drawing ratio was often associated with the defects such as breakage of monofilaments, generation of fuzz, and breakage of the entire fiber bundle. The situation was the same in the production of a fiber bundle with high fineness and the drawing at a higher speed.

Patent Document 1 discloses a technology for stable pressurized steam drawing wherein the heat is removed after the pressure reduction by using a cooling pipe, and the heat removal is conducted to an excessive level to bring the vapor to its saturation state followed by the removal of the moisture droplets generated by using a buffled moisture removal tank.

Patent Document 2 discloses a technology used in the steam drawing method wherein the drawing step is separately carried out in a preheating zone and a heating zone by supplying pressurized steam at different pressure, and in this technology, the pressurized steam introduced into the heated drawing step has a higher moisture content than the pressurized steam introduced into the preheating zone in view of preventing unnatural drawing at a low temperature caused by the shifting of the drawing point to the preheating zone.

Patent Document 3 discloses a technology which is well adapted for use in stable production of high quality carbon fiber bundle wherein variation in the fineness is suppressed by regulating the pressure of the pressurized steam used for the preheating and the residence time in the preheating step as well as the pressure of the pressurized steam used for the drawing and the residence time in the drawing step.

Patent Document 4 discloses a technology wherein moisture corresponding to the temperature detected is supplied to the pressurized steam supplied to the steam chamber by using an atomizer to reduce the temperature difference with the saturated vapor temperature to the range of up to 2° C. while detecting the temperature and the pressure of the steam for the purpose of regulating the temperature of the a steam chamber to which the pressurized steam is supplied, the sealed chamber on the inlet side of the steam drawing apparatus, and the exterior of the inlet of the steam drawing apparatus.

PATENT DOCUMENTS

Patent Document 1: Japanese Unexamined Patent Publication (Kokai) No. HEI-5-195313
Patent Document 2: Japanese Unexamined Patent Publication (Kokai) No. HEI-5-263313
Patent Document 3: Japanese Unexamined Patent Publication (Kokai) No. 2008-214795
Patent Document 4: Japanese Unexamined Patent Publication (Kokai) No. 2015-30923

SUMMARY OF THE INVENTION

In the method of Patent Document 1, however, it is difficult to follow the fluctuation of the temperature and flow rate of the cooling water or the fluctuation in the nature of the steam supplied, and this method was insufficient to fulfill the object of regulating the steam nature in stable manner. In addition, the aim of regulating the steam after supplying the steam to the steam drawing apparatus was not always realized by this method even if the steam before being supplied to the steam drawing apparatus were regulated.

In the method of Patent Document 2, when a highly humid wet steam is introduced in the heated drawing step, drain generation occurs upon collision of the steam to the wall of the steam drawing apparatus during the supply of the steam. The attachment of the drain to the fiber bundle results in the part where the drain has attached and the part where the drain has not attached, and the plasticizing effect of the fiber bundle is not efficiently realized in the part where the drain has not attached, and this often invited breakage of the monofilaments and breakage of acrylonitrile-based fiber bundle.

The method of Patent Document 3 required increase in the production speed if the production capacity was to be improved without large capital investment, and the resulting reduced residence time in the preheating zone and the heating zone was associated with the risk of the breakage of the monofilaments and breakage of the acrylonitrile-based fiber bundle due to the failure of obtaining the amount of heat necessary for the preheating and the drawing.

In the method of Patent Document 4, with regard to the steam supplied from the steam chamber to the inlet of the steam drawing apparatus, excessive water should be supplied to the pressurized steam supplied to the steam chamber in order to reduce the difference between the temperature of the sealed chamber on the inlet side of the steam drawing apparatus and the exterior of the inlet of the steam drawing apparatus and the saturated vapor temperature to the range of up to 2° C. In this case, the steam was a spray of large diameter water droplets at the stage of steam supplying even if the water spray diameter was reduced by using an atomizer and the steam and the water were uniformly mixed, and the collision of the large water droplets with the acrylonitrile-based fiber bundle invited the breakage of the monofilaments and the breakage of the acrylonitrile-based fiber bundle.

An object of the present invention is to obviate the defects of the prior art, and provide a drawing method which has realized an improved processability in the pressurized steam drawing of the acrylonitrile-based fiber bundle used as the precursor fiber of the carbon fiber bundle, and in particular, when the fiber bundle is subjected to the drawing at a high drawing ratio and high speed or the drawing for producing a fine fiber bundle.

In order to solve the problems as described above, the inventors of the present invention have made an intensive study and found that, in the pressurized steam drawing apparatus which has two zones, namely, the preheating zone on the side of the fiber bundle introduction and the heating zone on the side of the fiber bundle exit with the 2 zones separated by the seal member, the major drawing of the acrylonitrile-based fiber bundle by the pressurized steam drawing apparatus starts at the seal member between the preheating zone and the heating zone. It has also been found that interior of the preheating zone of the steam drawing apparatus suffers from temperature inconsistency, and this affects the processability. The present invention has been achieved on the basis of such finding.

The method for producing an acrylonitrile-based fiber bundle of the present invention is a method including the steps of spinning a spinning solution containing an acrylonitrile-based copolymer, and subjecting the fiber bundle to a pressurized steam drawing in a pressurized steam drawing apparatus having at least 2 zones which are a preheating zone on the fiber bundle inlet side and a heating zone on the fiber bundle exit side, the 2 zones being separated by a seal member; wherein the preheating zone is in a pressurized steam atmosphere at 0.05 to 0.35 MPa, the heating zone is in a pressurized steam atmosphere at 0.45 to 0.70 MPa, temperature difference $\Delta T1$ in the preheating step of the steam drawing apparatus in the fiber bundle-moving direction defined as described below is up to 5° C., and temperature difference $\Delta T2$ in the preheating step of the steam drawing apparatus in the cross-sectional direction of the steam drawing apparatus as described below is up to 5° C.

A method for producing a carbon fiber bundle of the present invention includes the steps of producing the acrylonitrile-based fiber bundle by the method for producing an acrylonitrile-based fiber bundle as described above, subjecting the fiber bundle to an oxidation treatment in an oxidizing atmosphere at 200 to 300° C., and heating the fiber bundle in an inert atmosphere of at least 1000° C.

In the present invention, "temperature difference $\Delta T1$ in the preheating zone of the steam drawing apparatus in the fiber bundle moving direction" is determined by the difference between the maximum value and minimum value of the T1a, T1b, and T1c; when the temperature measured in the preheating zone at a position 1 mm from the moving acrylonitrile-based fiber bundle and 5 cm from the seal member between the preheating zone and the heating zone is T1a; the temperature measured in the preheating zone at a position 1 mm from the moving acrylonitrile-based fiber bundle and 5 cm from the seal member on the exterior side of the steam drawing apparatus is T1c; and the temperature at the intermediate position between the positions where T1a and T1c are measured is T1b. It is to be noted that, in measuring the T1a, T1b, and T1c at a position 1 mm from the moving acrylonitrile-based fiber bundle, it is preferable to confirm that the thermometer and the moving fiber bundle are not in contact with each other by using a drawing apparatus provided with a sight glass.

In the present invention, "temperature difference $\Delta T2$ in the preheating zone of the steam drawing apparatus in the cross-sectional direction of the steam drawing apparatus" is determined by the difference between the maximum value and minimum value of the T2a, T2b, and T2c; when the temperature measured at the position T1a is T2b; the temperature measured at a position perpendicular to the moving direction of the fiber bundle movement and at a position 1 mm from the outer wall of the steam drawing apparatus is T2a; and the temperature measured at a position 1 mm from the outer wall of the steam drawing apparatus on the side opposite to the T2a, with T2b in between, is T2c.

The present invention has enabled realization of effective plasticization in the pressurized steam drawing of the acrylonitrile-based fiber bundle which is used as the precursor fiber of the carbon fiber bundle, and accordingly, the present invention will be a drawing method with excellent processability when used in the drawing at a high draw ratio, the drawing at a higher speed, the drawing to produce a fiber bundle having a high fineness, and the like. Accordingly, troubles such as breakage of the entire acrylonitrile-based fiber bundle will be prevented. Furthermore, breakage of the monofilaments and generation of fuzz can be prevented, and stable production of the high quality acrylonitrile-based fiber bundle will be enabled.

BRIEF DESCRIPTION OF THE DRAWING

FIG. 1 is a schematic side view showing an embodiment of the pressurized steam drawing apparatus according to the present invention.

DETAILED DESCRIPTION OF EMBODIMENTS OF THE INVENTION

Next, the present invention is described in detail by also referring to FIG. 1.

The method for producing an acrylonitrile-based fiber bundle of the present invention is a method comprising the steps of spinning a spinning solution containing an acrylonitrile-based copolymer, and then subjecting the fiber bundle to a pressurized steam drawing in a pressurized steam drawing apparatus.

The method used for spinning the spinning solution containing an acrylonitrile-based copolymer may be any one of the so-called wet spinning, dry-wet spinning, and dry spinning. The spinning solution used may be a solution of an acrylonitrile homopolymer or an acrylonitrile-based copolymer containing an acrylonitrile comonomer as the starting polymer in a known organic or inorganic solvent.

If desired, a step known in the field of fiber production may be adequately conducted before or after the pressurized steam drawing using the pressurized steam drawing apparatus. For example, solvent removal, drawing in a bath, oil agent-application, drying, and the like may be conducted after the spinning and before the pressurized steam drawing. While the pressurized steam drawing may be conducted in any stage in the fiber production process, the pressurized steam drawing is preferably conducted after the removal of the solvent in the fiber bundle to a certain degree, namely, after the washing or the drawing in the bath, or after the drying, and in view of producing a highly oriented fiber bundle, the pressurized steam drawing is preferably conducted after the drying.

In the present invention, the pressurized steam drawing apparatus used in subjecting the fiber bundle to the pressurized steam drawing is the apparatus which has two zones, namely, the preheating zone on the side of the fiber bundle inlet and the heating zone on the side of the fiber bundle exit and wherein the 2 zones are separated by the seal member. The seal member is not particularly limited as long as the pressure difference between the preheating zone and the heated drawing zone is created or maintained, and exemplary seal members include the one having a plurality of plates extending from the upper and lower surfaces of the inner wall of the steam drawing apparatus in the direction approaching the moving fiber thread from opposite sides or a series of two or more small diameter pipes, which are called "labyrinth nozzle". The labyrinth nozzle used may have any of round, rectangular, and oblong shapes, and it may be either an integral nozzle or separable nozzle. The labyrinth nozzle is not limited for the inner diameter, number of stages, and shape of the aperture control edge. In addition, the labyrinth nozzle is preferably made of a material having the mechanical strength sufficient for accomplishing the seal for preventing the steam leakage. For example, the part of the apparatus which may become in contact with the fiber bundle is preferably made of a chromium-plated stainless steel or steel material in view of the corrosion resistance and also in view of suppressing the damage to the fiber bundle upon contact with the fiber bundle, although the material used is not particularly limited. Use of the pressurized steam drawing apparatus having such structure enables even preheating of the entire acrylonitrile-based fiber bundle in the preheating zone and even drawing of the entire acrylonitrile-based fiber bundle in the subsequent heating zone. This enables prevention of the breakage of the entire acrylonitrile-based fiber bundle as well as the breakage of the monofilaments and the generation of fuzz which are likely to occur in the drawing.

In the present invention, such pressurized steam drawing apparatus is used so that the preheating zone is in the pressurized steam atmosphere of 0.05 to 0.35 MPa, and the subsequent heating zone is in the pressurized steam atmosphere of 0.45 to 0.70 MPa. Such pressure conditions of the pressurized steam atmosphere enables uniform preheating to the entire acrylonitrile-based fiber bundle in the preheating zone, and also, uniform drawing of the entire acrylonitrile-based fiber bundle in the heating zone. The pressure of the pressurized steam in the preheating zone and the heating zone can be measured by the device commonly used in the art, for example, by using Bourdon pressure gauge.

When the pressure of the preheating zone is less than 0.05 MPa, a part of the acrylonitrile-based fiber bundle will be subjected to the heating zone without being preheated, and this may result in the breakage of the monofilaments and generation of fuzz or breakage of the entire acrylonitrile-based fiber bundle in the heating zone. When the pressure of the pressurized steam in the preheating zone is in excess of 0.35 MPa, a part of the acrylonitrile-based fiber bundle will be excessively heated and drawn, and the lack of the uniform treatment will invite the breakage of the monofilaments and generation of fuzz or breakage of the entire acrylonitrile-based fiber bundle in the subsequent heating zone. In view of the situation as described above, the pressure of the pressurized steam in the preheating zone is preferably 0.10 to 0.30 MPa.

When the pressure of the pressurized steam in the heating zone is less than 0.45 MPa, some parts of the acrylonitrile-based fiber bundle are drawn while other parts are not drawn, and this may result in the breakage of the monofilaments and generation of fuzz or breakage of the entire acrylonitrile-based fiber bundle. When the pressure of the pressurized steam in the heating zone is in excess of 0.70 MPa, a part of the acrylonitrile-based fiber bundle will be excessively drawn, and this may result in the breakage of the monofilaments and generation of fuzz or breakage of the entire acrylonitrile-based fiber bundle. In view of the situation as described above, the pressure of the pressurized steam in the preheating zone is preferably 0.50 to 0.63 MPa.

In the present invention, adjustment of the pressure of the pressurized steam in the preheating zone and the heating zone to the ranges as described above may be accomplished by the combination of the regulation of the pressure of the steam supplied to the pressurized steam drawing apparatus and the regulation of the shape and the number of seal members $3b_1$ and $3b_2$ in the sealed area 3B between the preheating zone and the heating zone, seal members $3a_1$ and $3a_2$ in the sealed area 3A between the preheating zone and exterior of the steam drawing apparatus A, and seal members $3c_1$ and $3c_2$ in the sealed area 3C between the heating zone and the exterior of the steam drawing apparatus A. For example, the pressure difference between the adjacent zones separated by the seal member can be adjusted so that the pressure difference would be smaller when the seal member has a shape with a larger open area in the cross-section where the acrylonitrile-based fiber bundle passes through, and on the contrary, the pressure difference between the adjacent zones separated by the seal member can be adjusted so that the pressure difference would be larger by reducing the open area. In addition, the pressure difference between the adjacent zones separated by the seal member can be adjusted so that the pressure difference would be smaller by reducing the number of seal members in the sealed area 3B, and on the contrary, the pressure difference between the adjacent zones separated by the seal member can be adjusted so that the pressure difference would be larger by increasing the number of seal members in the sealed area 3B. When such adjustment is independently carried out for the sealed area 3B separating the preheating zone 1 and the heating zone 2, the sealed area 3A separating the preheating zone and the exterior of the steam drawing apparatus A, and the sealed area 3C separating the heating zone and the exterior of the steam drawing apparatus A, independent adjustment of the pressure in the preheating zone 1 and the heating zone 2 can be accomplished by using only one steam pressure controlling device in the steam drawing apparatus A.

The temperature difference ΔT1 in the preheating zone of the steam drawing apparatus in the fiber bundle-moving direction is up to 5° C., and temperature difference ΔT2 in. the preheating zone of the steam drawing apparatus in the cross-sectional direction of the steam drawing apparatus is up to 5° C. When the temperature conditions in the steam drawing apparatus are as described above, uniform preheating of the entire acrylonitrile-based fiber bundle can be carried out in the preheating zone to facilitate uniform drawing of the acrylonitrile-based fiber bundle in the subsequent heating zone. The temperature of the preheating zone and the heating zone may be measured by a device commonly used in the art, for example, by using a thermocouple.

When the temperature difference ΔT1 in the preheating zone of the steam drawing apparatus in the fiber bundle-moving direction is in excess of 5° C., the preheating of the acrylonitrile-based fiber bundle will be inconsistent, and this will result in the inconsistent drawing in the subsequent heating zone and breakage of the monofilaments and generation of fuzz or breakage of the entire acrylonitrile-based fiber bundle may be generated. In view of the situation as described above, temperature difference ΔT1 in the preheating zone of the steam drawing apparatus in the fiber bundle-moving direction is preferably up to 3° C. and more preferably up to 1° C.

When the temperature difference ΔT2 in the preheating zone of the steam drawing apparatus in the cross-sectional direction of the steam drawing apparatus is in excess of 5° C., the preheating of the acrylonitrile-based fiber bundle will be inconsistent, and this will result in the inconsistent drawing in the subsequent heating zone and breakage of the monofilaments and generation of fuzz or breakage of the entire acrylonitrile-based fiber bundle may be generated. In view of the situation as described above, the temperature difference ΔT2 in the preheating zone of the steam drawing apparatus in the cross-sectional direction of the steam drawing apparatus is preferably up to 3° C. and more preferably up to 1° C.

In the present invention, adjustment of the temperature difference ΔT1 and the temperature difference ΔT2 of the preheating zone to the ranges as described above can be accomplished by the combination of the adjustment by the seal members $3b_1$ and $3b_2$ provided in the sealed area 3B between the preheating zone and the heating zone and adjustment by seal members $3a_1$ and $3a_2$ provided in the sealed area 3A between the preheating zone and the exterior of the steam drawing apparatus. More specifically, the adjustment can be accomplished by regulating the temperature of the seal members $3a_1$ and $3a_2$ when the acrylonitrile-based fiber bundle enters the preheating zone from the exterior of the steam drawing apparatus; and by regulating the temperature of the seal members $3b_1$ and $3b_2$ when the steam supplied to the seal member heating zone is supplied to the preheating zone bypassing the seal members $3b_1$ and $3b_2$ or by regulating the temperature of the preheating zone on the side near the seal members $3b_1$ and $3b_2$. It is to be noted that, in the temperature regulation, the temperature of the seal member on the upper side and the lower side can be independently regulated. With regard to the adjustment of the ΔT1 to the range as described above, the ΔT1 can be adjusted to the smaller side, for example, by adjusting the temperature of the side which tends to exhibit the highest temperature (typically, the sealed area 3B) to a lower temperature range; or by adjusting the temperature of the side which tends to exhibit the lowest temperature (typically, the sealed area 3A) to a higher temperature range; in the temperature regulation of the temperature of the seal members in the sealed area 3A separating the preheating zone and the exterior of the steam drawing apparatus A and the sealed area 3B separating the preheating zone 1 and the heating zone 2. The adjustment of the ΔT2 to the range as described above may be accomplished, for example, by independently adjusting the temperature of the seal members on the upper side and the lower side provided in the sealed area 3B. With regard to the temperature adjustment in such occasion, the temperature regulation is preferably conducted by the cooling of the seal member as described below.

In the present invention, the fiber bundle stays in the preheating zone for a residence time of 1.0 to 2.5 seconds, and preferably for 1.0 to 1.5 seconds, and then, in the heating zone for a residence time of 0.2 to 1.0 second, and preferably for 0.2 to 0.5 second. When the residence time in the preheating zone is at least 1.0 second, the entire fiber bundle will be evenly and sufficiently preheated, and the drawing in the subsequent heating zone will be evenly conducted and the breakage of the entire fiber bundle as well as the breakage of the monofilaments and the generation of fuzz may be prevented. The residence time in the preheating zone of up to 2.5 seconds is preferable in view of the installation cost and productivity since increase in the size of the installation and decrease in the production speed will not be required. When the residence time in the heating zone is at least 0.2 second, the entire fiber bundle will be evenly and sufficiently heated, and the drawing will be evenly conducted and the breakage of the entire fiber bundle as well as the breakage of the monofilaments and the generation of fuzz may be prevented. In the meanwhile, the residence time in the heating zone of up to 1.0 second is preferable in view of the installation cost and productivity since increase in the size of the installation and decrease in the production speed will not be required. The residence time can be adjusted by changing the length of each zone in consideration of the moving speed and the draw ratio of the fiber bundle.

In the present invention, when the steam supplied to the heating zone is supplied to the preheating zone through seal members $3b_1$ and $3b_2$ in the sealed area 3B between the preheating zone and the heating zone, the seal members $3b_1$ and $3b_2$ are preferably cooled, or alternatively, the side of the preheating zone near the seal member may be cooled. The seal member used is typically a small diameter pipe called "labyrinth nozzle" which may be used as a set of two or more nozzles although the seal member is not limited to such nozzle. When the labyrinth nozzle is used, adjustment may be accomplished by the shape, size, and number of the small diameter nozzles used. The shape of the small diameter nozzles is not particularly limited as long as the fiber bundle can smoothly pass through the nozzle and the pressure according to the embodiments of the present invention is adequately maintained. It is not particularly limited whether the steam inlet is solely provided at the heating zone or independently provided at both the heating zone and the preheating zone since the steam coming into the heating zone will be supplied to the preheating zone through the seal members since the pressure of the heating zone is higher.

Exemplary methods for cooling the seal members $3b_1$ and $3b_2$ include cooling of the seal members by the cooling of the atmosphere where the steam drawing apparatus is placed, and cooling of the seal members $3b_1$ and $3b_2$ by water cooling of the steam drawing apparatus.

In the cooling of the seal members by the cooling of the atmosphere where the steam drawing apparatus is placed, the temperature of the atmosphere is typically kept at a temperature of up to 70° C., preferably up to 60° C., and more preferably up to 50° C. This method of cooling the atmosphere where the steam drawing apparatus is placed has the merit that no additional device for the cooling is required, enabling a convenient cooling of the seal member. In this method, the temperature of the atmosphere is to be measured at a position 10 cm in the perpendicular direction of the steam drawing apparatus from the position where T1a is measured in the steam drawing apparatus as described above.

With regard to the method wherein the cooling of the seal members $3b_1$ and $3b_2$ is conducted by water cooling of the steam drawing apparatus, exemplary such methods include the method wherein a certain amount of water is directly applied to the steam drawing apparatus, the method wherein the water in the form of mist is directly applied to the steam drawing apparatus by using a spray nozzle, and a method wherein the steam drawing apparatus is constituted in a double pipe structure and warm water is allowed to pass through the outer pipe.

Next, the method for producing a carbon fiber bundle from the acrylonitrile-based fiber bundle produced by the method for producing an acrylonitrile-based fiber bundle of the present invention is described.

The acrylonitrile-based fiber bundle produced by the production method of the acrylonitrile-based fiber bundle as described above is subjected to oxidation treatment in an oxidizing atmosphere such as air at 200 to 300° C. With regard to the temperature used in this treatment, the temperature is preferably raised incrementally from a low temperature to a high temperature in two or more steps in view of producing the oxidation-treated fiber bundle. In addition, the fiber bundle is preferably drawn at a highest possible draw ratio that does not induce fuzz generation in view of sufficiently expressing the performance of the carbon fiber bundle. Next, the resulting oxidation-treated fiber bundle is heated in an inert atmosphere such as nitrogen to a temperature of at least 1000° C. to produce the carbon fiber bundle. Subsequently, anode oxidization may be conducted in an aqueous electrolyte solution to provide a functional group on the surface of the carbon fiber bundle to thereby improve adhesion property with the resin. In addition, it is also preferable that a sizing agent such as epoxy resin is provided on the fiber bundle to obtain a carbon fiber bundle having excellent abrasion resistance.

EXAMPLES

Next, the present invention is described in further detail by referring to the Examples.

(Residence Time in the Steam Drawing Apparatus)

A sight glass was placed at the heating zone inlet of the drawing apparatus, and the fiber bundle was marked with an oil-based marker on the inlet side of the drawing apparatus to measure the time that had passed until the passage of the sight glass and the time that had passed until the exit from the drawing apparatus. The measurement was conducted 10 times by using a stopwatch, and the average was used for the residence time.

(Quality of the Acrylonitrile-Based Fiber Bundle)

The quality was evaluated by counting the number of fuzz fibers per 1000 m of acryl-based fiber bundle before the winding of the acrylonitrile-based fiber bundle. The criteria used were as described below.

1: (number of fuzz fibers/1000 m of fiber bundle)≤1
2: 1<(number of fuzz fibers/1000 m of fiber bundle)≤2
3: 2<(number of fuzz fibers/1000 m of fiber bundle)≤5
4: 5<(number of fuzz fibers/1000 m of fiber bundle)<60
5: (number of fuzz fibers/1000 m of fiber bundle)≥60

(Processability of the Acrylonitrile-Based Fiber Bundle)

The processability was evaluated from the fiber bundle breakage in the production of the 10 t acrylonitrile-based fiber bundle. The criteria used were as described below.

1: (number of fiber bundle breakage/production of 10 t acrylonitrile-based fiber bundle)≤1
2: 1<(number of fiber bundle breakage/production of 10 t acrylonitrile-based fiber bundle)≤2
3: 2<(number of fiber bundle breakage/production of 10 t acrylonitrile-based fiber bundle)≤3
4: 3<(number of fiber bundle breakage/production of 10 t acrylonitrile-based fiber bundle)<5
5: (number of fiber bundle breakage/production of 10 t acrylonitrile-based fiber bundle)≥5

Example 1

A solution of acrylonitrile-based copolymer in dimethylsulfoxide containing 99% by mole of acrylonitrile and 1% by mole of itaconic acid was ejected from a 4000 hole nozzle for dry-wet spinning, and 3 bundles were immediately brought together to form a bundle of 12000 filaments. The bundle was drawn at a draw ratio of 2 in a warm water of 40° C., and after washing and further drawing at a draw ratio of 2 in a warm water of 70° C., the bundle was dried to produce a fiber bundle of 12000 filaments having a total dtex of 66000. This fiber bundle was supplied to the steam drawing apparatus shown in FIG. 1, and drawn in the conditions shown in Table 1 to produce an acryl fiber bundle of 12,000 filaments having a unit fineness of 1.1 dtex. The evaluation results of the quality and processability of the resulting acryl fiber bundle and the temperature measurement in the steam drawing apparatus are shown in Table 2.

Example 2

The procedure of Example 1 was repeated except that the pressure in the steam drawing apparatus was changed as shown in Table 1 to obtain the acryl fiber bundle. The evaluation results of the quality and processability of the resulting acryl fiber bundle and the temperature measurement in the steam drawing apparatus are shown in Table 2.

Example 3

The procedure of Example 1 was repeated except that the pressure in the steam drawing apparatus and the temperature of the atmosphere were changed as shown in Table 1 to obtain the acryl fiber bundle. The evaluation results of the quality and processability of the resulting acryl fiber bundle and the temperature measurement in the steam drawing apparatus are shown in Table 2.

Example 4

The procedure of Example 3 was repeated except that the temperature of the atmosphere was changed, water cooling was used for the cooling of the seal members $\mathbf{3}c_1$ and $\mathbf{3}c_2$ of the steam drawing apparatus, and water at a flow rate of 2 L/minute was directly applied to the seal members $\mathbf{3}c_1$ and $\mathbf{3}c_2$ of the steam drawing apparatus in the form of a spray mist having a diameter of 50 μm by using a spray nozzle as shown in Table 1 to obtain the acryl fiber bundle. The evaluation results of the quality and processability of the resulting acryl fiber bundle and the temperature measurement in the steam drawing apparatus are shown in Table 2.

Example 5

The procedure of Example 3 was repeated except that water cooling was used for the cooling of the seal members $\mathbf{3}c_1$ and $\mathbf{3}c_2$ of the steam drawing apparatus, and water at a flow rate of 2 L/minute was applied to the exterior of the steam drawing apparatus having a double pipe structure wherein difference between the outer diameter of the drawing apparatus where the fiber bundle passes and the inner diameter of the double pipe where water passes was 15 mm as shown in Table 1 to obtain the acryl fiber bundle. The evaluation results of the quality and processability of the resulting acryl fiber bundle and the temperature measurement in the steam drawing apparatus are shown in Table 2.

Example 6

(A Method Similar to Comparative Example 1 of Japanese Unexamined Patent Publication (Kokai) No. 2008-214795)

The procedure of Example 5 was repeated except that the residence time in the steam drawing apparatus was changed as shown in Table 1 to obtain the acryl fiber bundle. The evaluation results of the quality and processability of the resulting acryl fiber bundle and the temperature measurement in the steam drawing apparatus are shown in Table 2.

Example 7

The procedure of Example 2 was repeated except that water cooling was used for the cooling of the seal members $3c_1$ and $3c_2$ of the steam drawing apparatus, and water at a flow rate of 2 L/minute was applied to the exterior of the steam drawing apparatus having a double pipe structure as shown in Table 1 to obtain the acryl fiber bundle. The evaluation results of the quality and processability of the resulting acryl fiber bundle and the temperature measurement in the steam drawing apparatus are shown in Table 2.

Example 8

The procedure of Example 3 was repeated except that the residence time in the steam drawing apparatus was changed as shown in Table 1 to obtain the acryl fiber bundle. The evaluation results of the quality and processability of the resulting acryl fiber bundle and the temperature measurement in the steam drawing apparatus are shown in Table 2.

Example 9

The procedure of Example 7 was repeated except that the residence time in the steam drawing apparatus was changed as shown in Table 1 to obtain the acryl fiber bundle. The evaluation results of the quality and processability of the resulting acryl fiber bundle and the temperature measurement in the steam drawing apparatus are shown in Table 2.

Comparative Example 1

(A Method Similar to Example 1 of Japanese Unexamined Patent Publication (Kokai) No. 2008-214795)

The procedure of Example 1 was repeated except that the cooling method of the steam drawing apparatus was changed as shown in Table 1 to obtain the acryl fiber bundle. The evaluation results of the quality and processability of the resulting acryl fiber bundle and the temperature measurement in the steam drawing apparatus are shown in Table 2.

Comparative Example 2

(Example 1 of Japanese Unexamined Patent Publication (Kokai) No. 2008-214795)

The procedure of Comparative Example 1 was repeated except that the residence time in the steam drawing apparatus was changed as shown in Table 1 to obtain the acryl fiber bundle. The evaluation results of the quality and processability of the resulting acryl fiber bundle and the temperature measurement in the steam drawing apparatus are shown in Table 2.

Comparative Example 3

The procedure of Example 2 was repeated except that the cooling method of the steam drawing apparatus was changed as shown in Table 1 to obtain the acryl fiber bundle. The evaluation results of the quality and processability of the resulting acryl fiber bundle and the temperature measurement in the steam drawing apparatus are shown in Table 2.

Comparative Example 4

The procedure of Examples 3 to 0.5 was repeated except that the cooling method of the steam drawing apparatus was changed as shown in Table 1 to obtain the acryl fiber bundle. The evaluation results of the quality and processability of the resulting acryl fiber bundle and the temperature measurement in the steam drawing apparatus are shown in Table 2.

Comparative Example 5

The procedure of Example 6 was repeated except that the pressure in the steam drawing apparatus was changed as shown in Table 1 to obtain the acryl fiber bundle. The evaluation results of the quality and processability of the resulting acryl fiber bundle and the temperature measurement in the steam drawing apparatus are shown in Table 2.

TABLE 1

| | Preheated drawing step | | Heated drawing step | | | Cooling method of the seal member | |
|---|---|---|---|---|---|---|---|
| | Pressure in the tube MPa | Residence time Second | Pressure in the tube MPa | Temp. in the tube ° C. | Residence time Second | Temp. of atmosphere ° C. | Water cooling method — |
| Example 1 | 0.35 | 1.2 | 0.51 | 159 | 0.3 | 65 | Not used |
| Example 2 | 0.2 | 1.2 | 0.51 | 159 | 0.3 | 65 | Not used |
| Example 3 | 0.05 | 1.2 | 0.65 | 168 | 0.3 | 50 | Not used |
| Example 4 | 0.05 | 1.2 | 0.65 | 168 | 0.3 | 65 | Direct application |
| Example 5 | 0.05 | 1.2 | 0.65 | 168 | 0.3 | 65 | Double pipe |
| Example 6 | 0.05 | 2.5 | 0.51 | 159 | 0.7 | 65 | Double pipe |
| Example 7 | 0.2 | 1.2 | 0.51 | 159 | 0.3 | 65 | Double pipe |
| Example 8 | 0.05 | 2.5 | 0.65 | 168 | 1.0 | 50 | Not used |
| Example 9 | 0.2 | 0.8 | 0.51 | 159 | 0.2 | 65 | Double pipe |
| Comparative Example 1 | 0.35 | 1.2 | 0.51 | 159 | 0.3 | 80 | Not used |
| Comparative Example 2 | 0.35 | 2.5 | 0.51 | 159 | 0.7 | 80 | Not used |
| Comparative Example 3 | 0.2 | 1.2 | 0.51 | 159 | 0.3 | 80 | Not used |
| Comparative Example 4 | 0.05 | 1.2 | 0.65 | 168 | 0.3 | 80 | Not used |
| Comparative Example 5 | 0.02 | 2.5 | 0.51 | 159 | 0.7 | 65 | Double pipe |

TABLE 2

| | Moving direction of fiber | | | | Cross-sectional direction of the drawing tube | | | | | |
|---|---|---|---|---|---|---|---|---|---|---|
| | Temp. T1a ° C. | Temp. T1b ° C. | Temp. T1c ° C. | Temp. ΔT1 ° C. | Temp. T2a ° C. | Temp. T2b ° C. | Temp. T2c ° C. | Temp. ΔT2 ° C. | Quality of acrylonitrile-based fiber bundle | Processability of acrylonitrile-based fiber bundle |
| Example 1 | 152 | 151 | 149 | 3 | 149 | 152 | 148 | 4 | 2 | 2 |
| Example 2 | 140 | 138 | 136 | 4 | 136 | 140 | 137 | 4 | 2 | 2 |
| Example 3 | 116 | 114 | 113 | 3 | 114 | 116 | 112 | 4 | 2 | 2 |
| Example 4 | 116 | 114 | 112 | 4 | 113 | 116 | 113 | 3 | 2 | 2 |
| Example 5 | 115 | 113 | 112 | 3 | 112 | 115 | 114 | 3 | 2 | 2 |
| Example 6 | 114 | 113 | 112 | 2 | 113 | 114 | 112 | 2 | 2 | 1 |
| Example 7 | 135 | 134 | 134 | 1 | 134 | 135 | 134 | 1 | 1 | 1 |
| Example 8 | 116 | 115 | 113 | 3 | 114 | 116 | 112 | 4 | 1 | 2 |
| Example 9 | 135 | 135 | 134 | 1 | 134 | 135 | 135 | 1 | 2 | 2 |
| Comparative Example 1 | 156 | 152 | 150 | 6 | 150 | 156 | 149 | 7 | 4 | 3 |
| Comparative Example 2 | 156 | 153 | 150 | 6 | 151 | 156 | 150 | 6 | 3 | 3 |
| Comparative Example 3 | 144 | 141 | 136 | 8 | 136 | 144 | 135 | 9 | 4 | 4 |
| Comparative Example 4 | 125 | 120 | 114 | 11 | 113 | 125 | 115 | 12 | 5 | 5 |
| Comparative Example 5 | 111 | 109 | 105 | 6 | 106 | 111 | 105 | 6 | 4 | 4 |

EXPLANATION OF NUMERALS

A steam drawing apparatus
B moving direction of the fiber bundle
C cross-sectional direction of the steam drawing apparatus
1 preheating zone
2 heating zone
3A to 3C sealed area
3$a_1$ to 3$c_2$ seal member
4 steam pressure controlling device
5 pressure gauge (PI)
6 thermometer (TI)
7 fiber bundle

The invention claimed is:

1. A method for producing an acrylonitrile-based fiber bundle comprising the steps of:

spinning a spinning solution containing an acrylonitrile-based copolymer; and subjecting the fiber bundle to a pressurized steam drawing in a pressurized steam drawing apparatus having at least two zones which are a preheating zone on the fiber bundle inlet side and a heating zone on the fiber bundle exit side, the two zones being separated by a seal member; wherein the preheating zone is in a pressurized steam atmosphere at 0.05 to 0.35 MPa, the heating zone is in a pressurized steam atmosphere at 0.45 to 0.70 MPa, temperature difference ΔT1 in the preheating zone of the steam drawing apparatus in the fiber bundle-moving direction defined in the specification is up to 5° C., and temperature difference ΔT2 in the preheating zone of the steam drawing apparatus in the cross-sectional direction of the steam drawing apparatus defined in the specification is up to 5° C., wherein the seal member is cooled when the steam supplied to the heating zone is supplied to the preheating zone through the seal member, and wherein the seal member is cooled by regulating the temperature of the atmosphere in which the steam drawing apparatus is placed to the range of up to 70° C.

2. The method for producing an acrylonitrile-based fiber bundle according to claim 1 wherein the fiber bundle stays in the preheating zone for a residence time of 1.0 to 2.5 seconds, and then in the heating zone for a residence time of 0.2 to 1.0 second.

3. The method for producing an acrylonitrile-based fiber bundle according to claim 1 wherein the seal member is cooled by water-cooling the steam drawing apparatus.

4. A method for producing a carbon fiber bundle comprising the steps of producing an acrylonitrile-based fiber bundle by the method for producing an acrylonitrile-based fiber bundle according to claim 1, subjecting the acrylonitrile-based fiber bundle to an oxidation treatment in an oxidizing atmosphere at 200 to 300° C., and heating the acrylonitrile-based fiber bundle in an inert atmosphere of at least 1000° C.

* * * * *